US008026865B2

(12) United States Patent
Chen et al.

(10) Patent No.: US 8,026,865 B2
(45) Date of Patent: Sep. 27, 2011

(54) ANTENNA MODULE AND MANUFACTURING METHOD THEREOF

(75) Inventors: Hen-An Chen, Taipei (TW); Wen-Kuei Lo, Taipei (TW); Bing-Chun Chung, Taipei (TW)

(73) Assignee: Wistron NeWeb Corp., Hsinchu (TW)

( * ) Notice: Subject to any disclaimer, the term of this patent is extended or adjusted under 35 U.S.C. 154(b) by 482 days.

(21) Appl. No.: 12/168,097

(22) Filed: Jul. 4, 2008

(65) Prior Publication Data

US 2009/0184885 A1 Jul. 23, 2009

(30) Foreign Application Priority Data

Jan. 22, 2008 (TW) ..... 97201378 U

(51) Int. Cl.
*H01Q 1/50* (2006.01)

(52) U.S. Cl. ..... 343/906; 29/601; 343/873

(58) Field of Classification Search ..... 343/906, 343/905, 846, 829, 702, 795, 873; 439/916; 29/600, 601; 264/272.11
See application file for complete search history.

(56) References Cited

U.S. PATENT DOCUMENTS 5,982,336 A * 11/1999 Wen et al. ..... 343/793
6,426,724 B2 * 7/2002 Gunee et al. ..... 343/702
6,486,834 B2 * 11/2002 Tsai ..... 343/702
7,322,833 B1 * 1/2008 Hakansson et al. ..... 439/67

* cited by examiner

*Primary Examiner* — Michael C Wimer

(57) ABSTRACT

An antenna module is disclosed, including an electronic element, an antenna and a connecting element. The antenna includes a hole. The connecting element includes a first connecting portion, a propping portion and a second connecting portion. The first connecting portion passes through the hole and is fixed to the antenna by the propping portion. The second connecting portion is electrically connected to the electronic element.

9 Claims, 6 Drawing Sheets

ANTENNA MODULE AND MANUFACTURING METHOD THEREOF

BACKGROUND OF THE INVENTION

1. Field of the Invention

The invention relates to an antenna module and a manufacturing method thereof, and more particularly to an antenna module fixed via mechanical coupling and a manufacturing method thereof.

2. Description of the Related Art

A conventional antenna module comprises an antenna, an electronic element, and a plastic assembly. The electronic element may be a printed circuit board, a cable or another antenna. The antenna is electrically connected to the electronic element by soldering or adhesive. Then, the antenna and the electronic element are covered by a plastic assembly via injection molding for protecting the inner elements thereof. The above-mentioned steps form the antenna module.

During injection molding, high temperature and high pressure are generated. The soldering and adhesive areas on the antenna, which can not bear the high temperatures and high pressures are melted and then sealed off, resulting in an imperfect contact or no signal. Thus, the conventional antenna has low manufacturing yields.

BRIEF SUMMARY OF THE INVENTION

The invention provides an antenna module comprising an electronic element, a first antenna and a connecting element. The first antenna comprises a first hole. The connecting element comprises a first connecting portion, a first propping portion and a second connecting portion. The first connecting portion passes through the first hole and is fixed to the first antenna by the first propping portion for fixation. The second connecting portion is electrically connected to the electronic element.

The invention further provides a manufacturing method of an antenna. The steps comprise: providing an antenna, and the antenna comprising a first hole; providing a connecting element with a first connecting portion and a second connecting portion; inserting the first connecting portion into the first hole; bending the first connecting portion to form a first propping portion for fixing the first connecting portion in the first hole; connecting the second connecting portion to the electronic element; and packaging the first antenna, the connecting element and the electronic element via injection molding.

The invention can be more fully understood by reading the subsequent detailed description and examples with references made to the accompanying drawings, wherein:

DETAILED DESCRIPTION OF THE INVENTION

Figure 1:
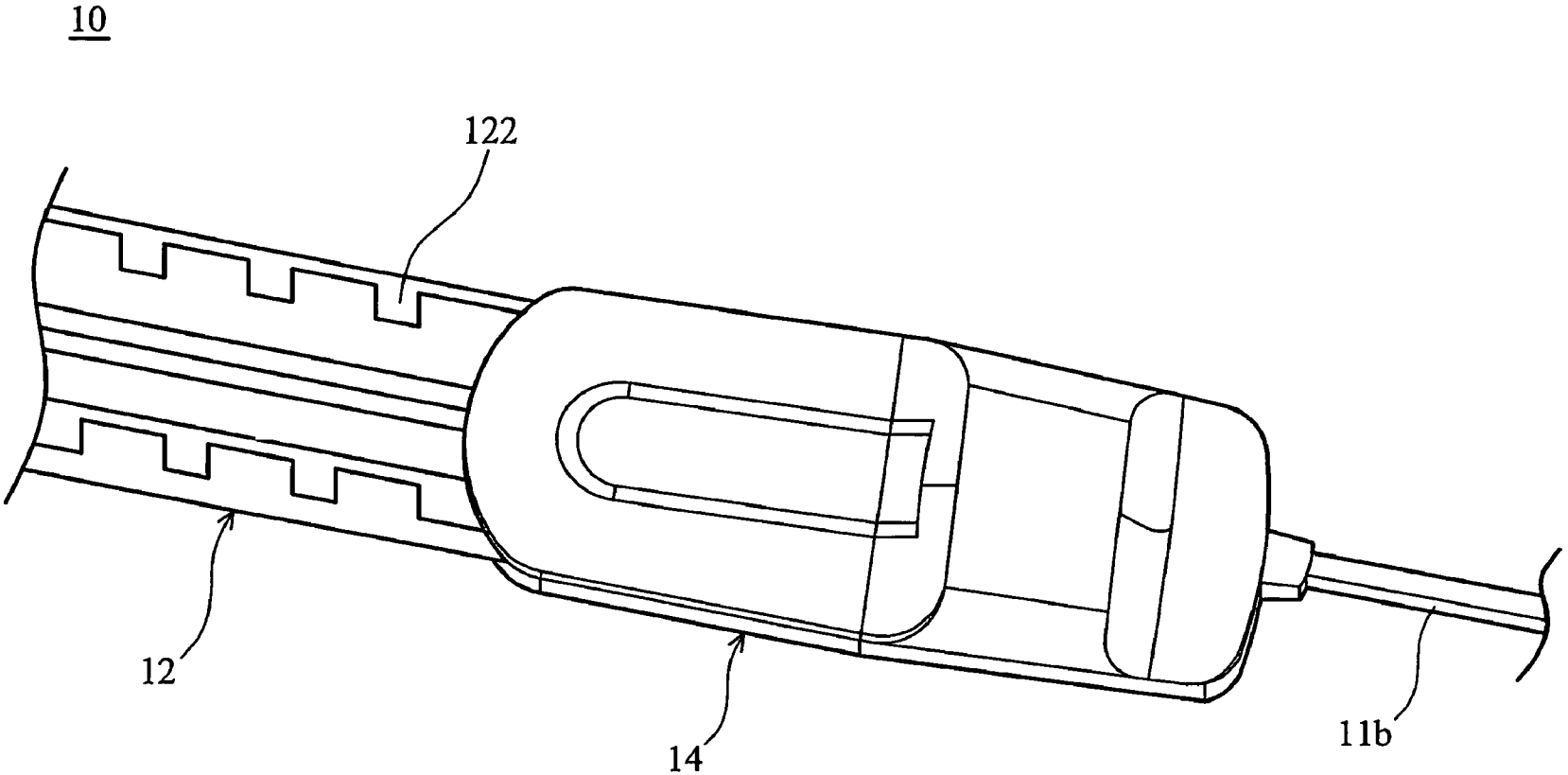
FIG. 1 is a schematic view of an antenna of the invention.
Figure 2:
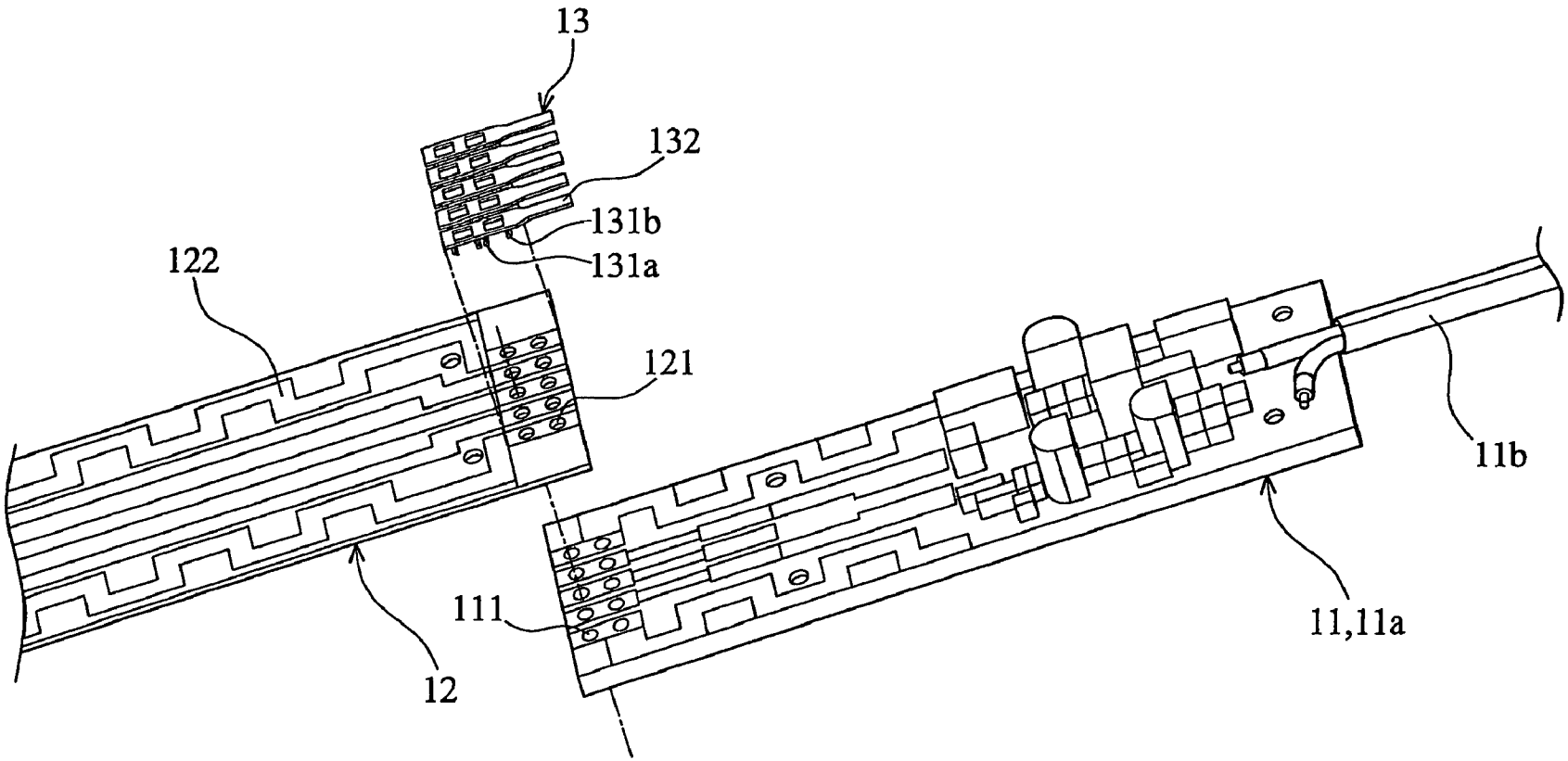
FIG. 2 is an exploded view of a first antenna.

Referring to FIGS. 1 and 2, FIG. 1 is a schematic view of an antenna of the invention, and FIG. 2 is an exploded view of a first antenna, a connecting element and an electronic element of an antenna module of the invention. The antenna module 10 comprises an electronic element 11, a first antenna 12, a connecting element 13 and a plastic assembly 14. The first antenna 12 is electrically connected to the electronic element 11 via the connecting element 13. In this embodiment, the electronic element 11 is a circuit board 11*a*. The circuit board 11*a* is electrically connected to a cable 11*b*.

Figure 3A:
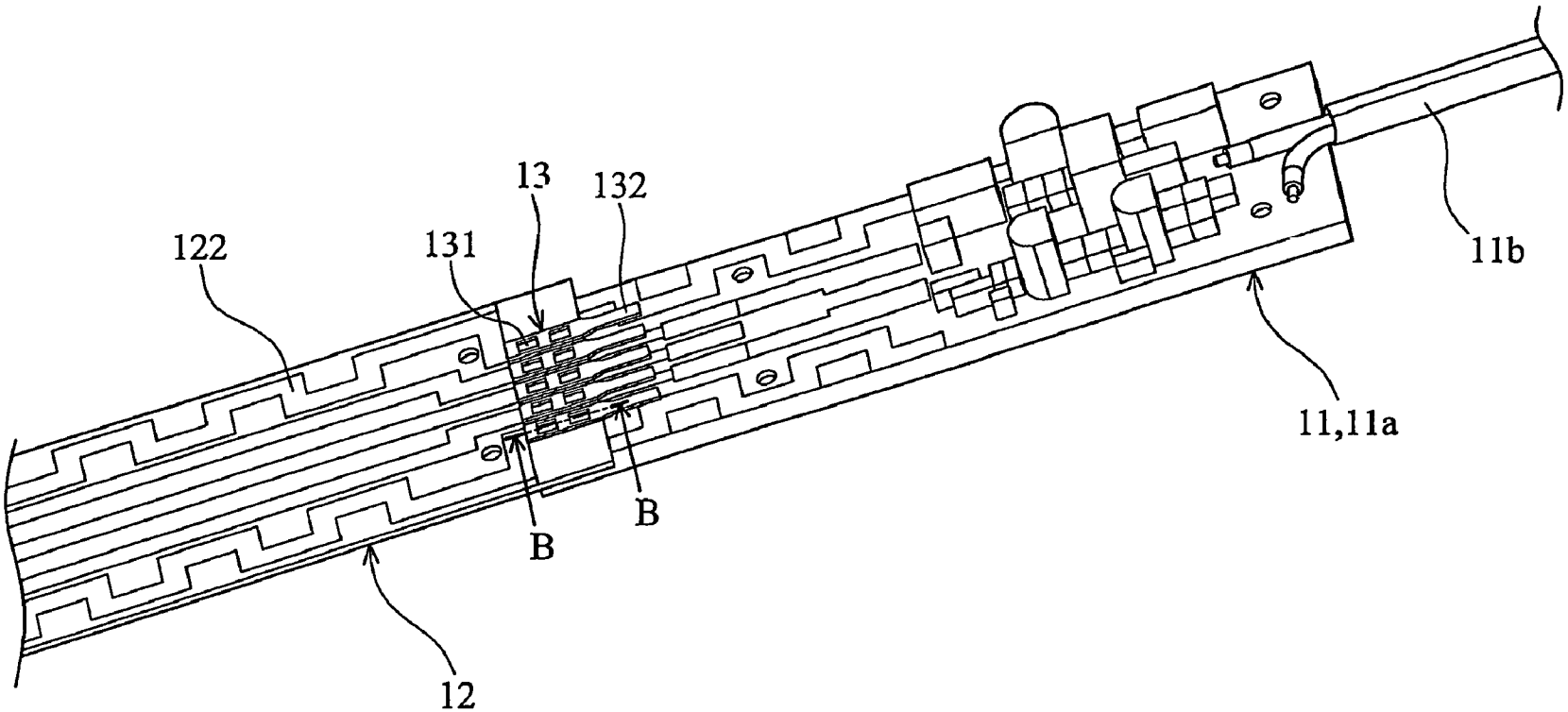
FIG. 3A is a schematic view of a first antenna.
Figure 3B:
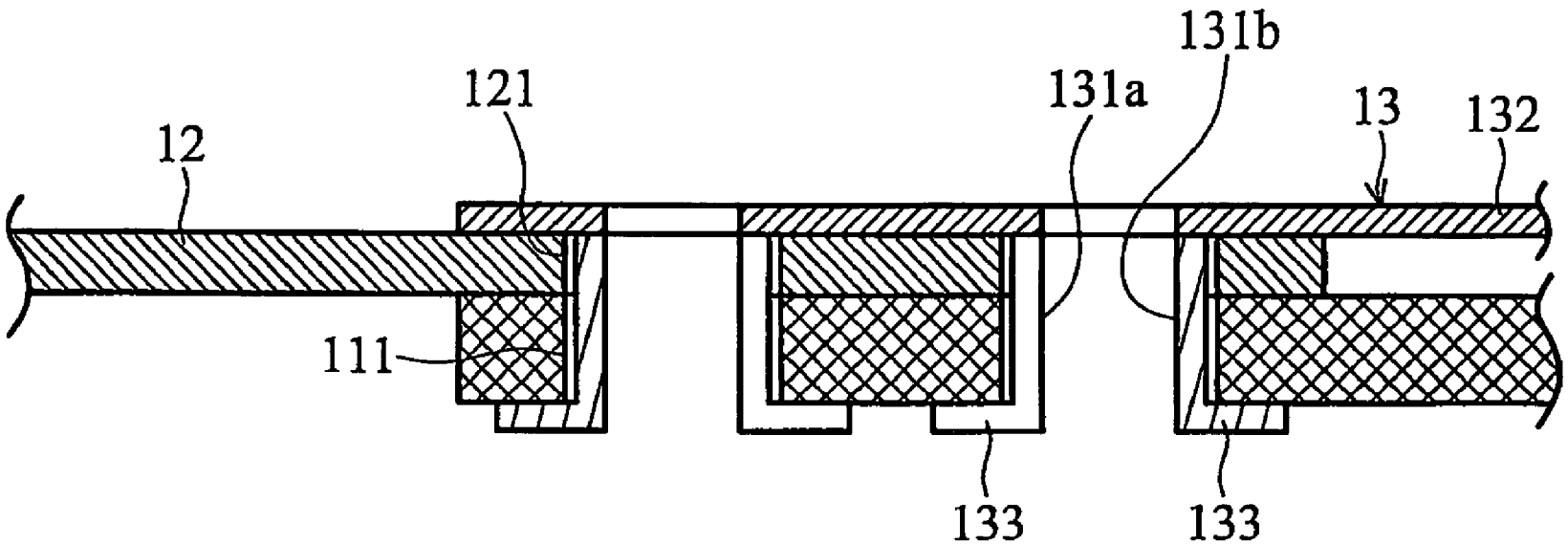
FIG. 3B is a cross-sectional view along B-B of FIG. 3A.
Figure 5:
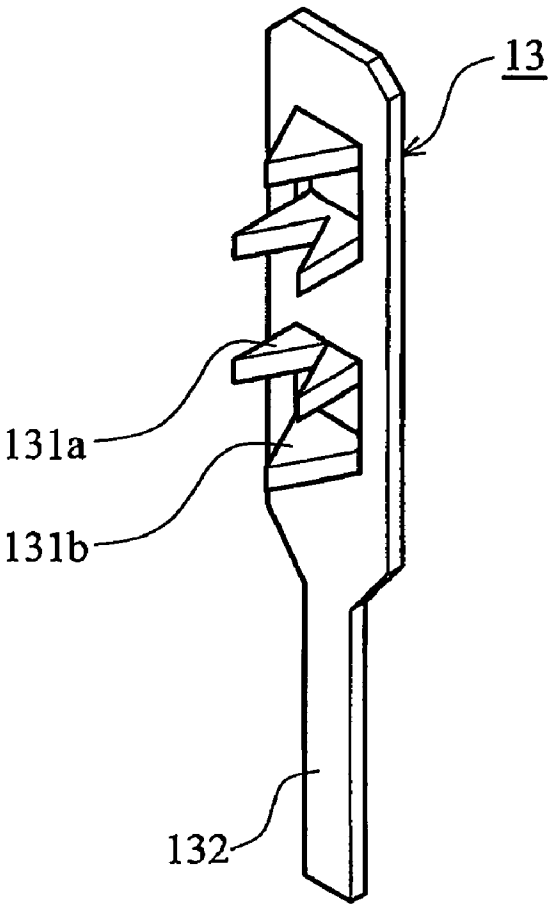
FIG. 5 is a lateral view of a connecting element of the invention.
Figure 4:
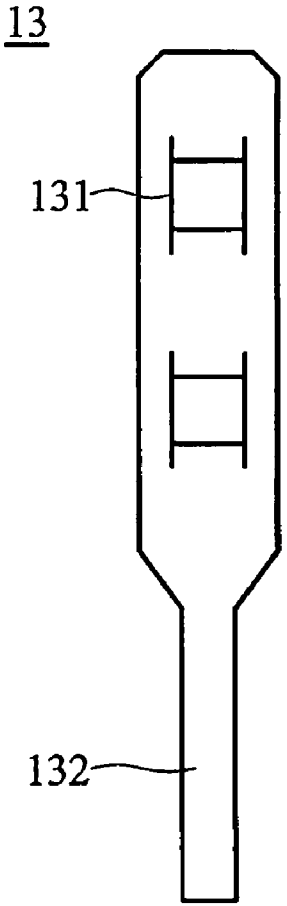
FIG. 4 is a schematic view of a connecting element of the invention.

Referring to FIGS. 4 and 5, FIG. 4 is a schematic view of a connecting element of the invention, and FIG. 5 is a lateral view of a connecting element of the invention. The connecting element 13 comprises two first connecting portions 131*a* and 131*b* and a second connecting portion 132. In this embodiment, the first connecting portions 131*a* and 131*b* are protrusions protruding downward, and are respectively bended toward two contrary directions for fixation. The second connecting portion 132 protrudes toward lateral directions. Referring to FIGS. 2, 3A and 3B, FIG. 3A is a schematic view that a first antenna, a connecting element and an electronic element of FIG. 2 are assembled. FIG. 3B is a cross-sectional view along B-B of FIG. 3A. The first antenna 12 comprises a first hole 121 and an electric circuit 122. The circuit board 11*a* comprises an opening 111. The first connecting portions 131*a* and 131*b* pass through the first hole 121 and an opening 111 for connecting the first antenna 12 to the circuit board 11*a*. The first connecting portions 131*a* and 131*b* which are protrusions are bent to respectively form a first propping portion 133. The first propping portion 133 props against the opening 111 for fixing the first antenna 12 on the circuit board 11*a*. The second connecting portion 132 is electrically connected to the electronic element 11 by soldering or adhesive. Note that the plastic assembly 14 covers the electronic element 11, the first antenna 12, and the connecting element 13 via injection molding. The first connecting portions 131*a* and 131*b* are electrically connected to the electric circuit 122 of the first antenna 12.

Note that soldering and adhesive areas on the antenna can not bear high temperatures and high pressures. Thus, if the electronic element 11 is a second antenna (not shown), the electronic element 11 is assembled with the first antenna by the fixing method such as the method that the first connecting portions 131*a* and 131*b* are connected to the first antenna 12. If the electronic element 11 is a second antenna, the electronic element 11 would not be soldered or adhered by the adhesive for connection to the second connecting portion 132.

Figure 6:
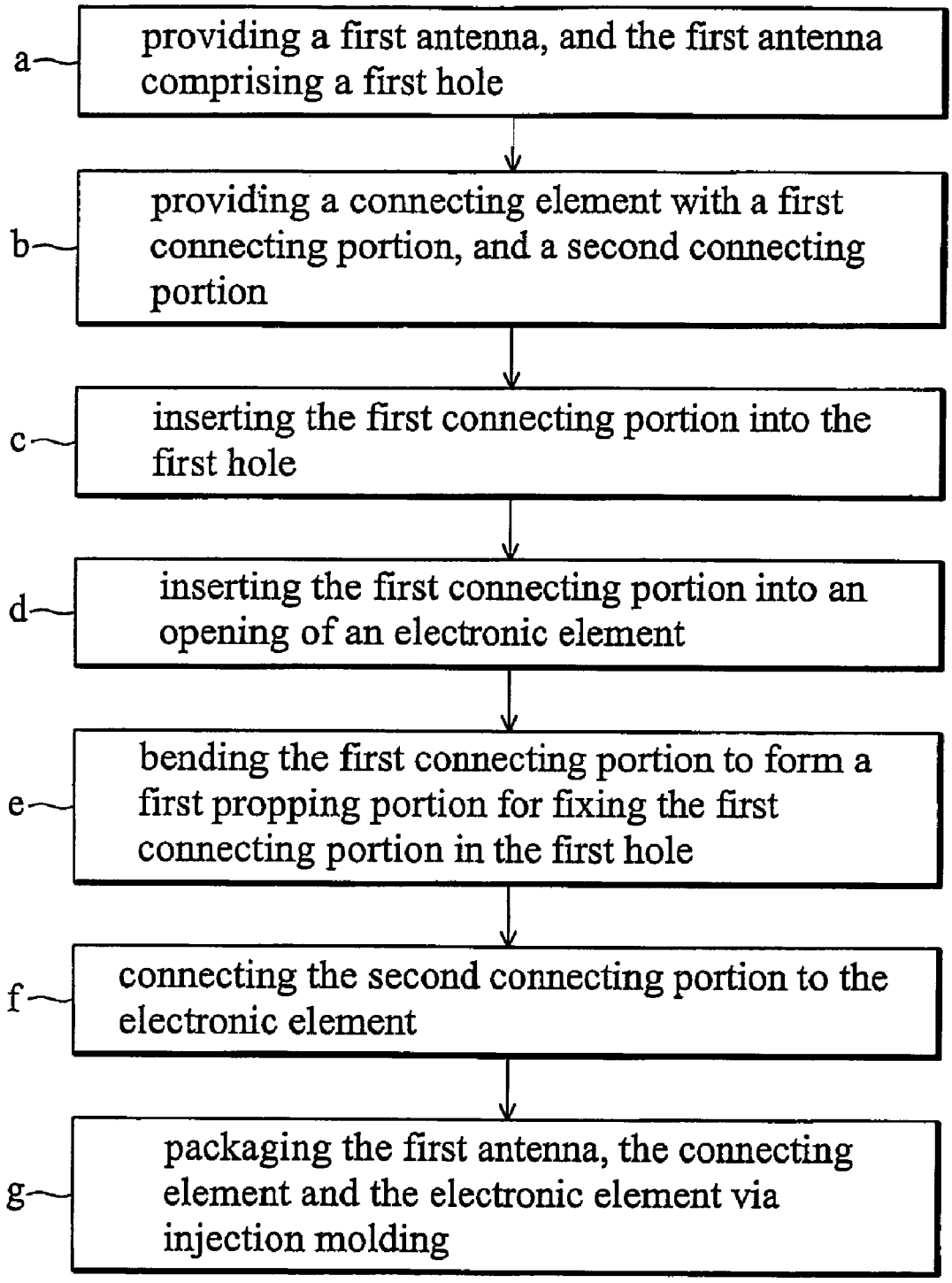
FIG. 6 is a flow chart of a manufacturing method of an antenna module of the invention.

Referring to FIG. 6, FIG. 6 is a flow chart of a manufacturing method of an antenna module of the invention. Referring to FIGS. 1 to 6, the steps comprises: a. providing a first antenna 12, and the first antenna 12 comprising a first hole 121; b. providing a connecting element 13 with two first connecting portions 131*a* and 131*b*, and a second connecting portion 132; c. inserting the first connecting portions 131*a* and 131*b* into the first hole 121; d. inserting the first connecting portions 131*a* and 131*b* into an opening 111 of an electronic element 11; e. bending the first connecting portions 131*a* and 131*b* to form a first propping portion 133 for fixing the first connecting portions 131*a* and 131*b* in the first hole 121; f. connecting the second connecting portion 132 to the electronic element 11; and g. packaging the first antenna 12, the connecting element 13 and the electronic element 11 via injection molding.

Because soldering and adhesive areas on the antenna can not bear high temperatures and high pressures generated by injection molding, the invention provides a connecting element 13 to connect the first antenna 12 to the electronic element 11 to avoid the soldering and the adhesive areas to be melted or sealed off. Thus, manufacturing yields effectively increases.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna module, comprising:

a first antenna having a first hole;

a second antenna comprising a second hole; and a connecting element comprising a first connecting portion, a first propping portion, and a second connecting portion comprising a second propping portion, wherein the first connecting portion passes through the first hole and is fixed to the first antenna by the first propping portion, the second connecting portion is electrically connected to second antenna, and the second propping portion passes through the second hole and is propped against the second antenna for connecting the connecting element to the second antenna.

2. The antenna module as claimed in claim 1, wherein the second antenna comprises an opening corresponding to the first hole, and the first propping portion passes through the opening for connecting the connecting element, the first antenna, and the second antenna.

3. The antenna module as claimed in claim 1, wherein the first antenna further comprises an electric circuit, and the first connecting portion is electrically connected to the electronic circuit.

4. The antenna module as claimed in claim 1, further comprising a plastic assembly covering the second antenna, the first antenna, and the connecting element.

5. The antenna module as claimed in claim 4, wherein the plastic assembly covers the second antenna, the first antenna, and the connecting element via injection molding.

6. A manufacturing method of an antenna, the step comprising:

providing a first antenna, and the first antenna comprising a first hole;

providing a connecting element with a first connecting portion and a second connecting portion;

inserting the first connecting portion into the first hole;

bending the first connecting portion to form a first propping portion for fixing the first connecting portion in the first hole;

connecting the second connecting portion to an electronic element; and packaging the first antenna, the connecting element, and the electronic element via injection molding.

7. The manufacturing method of an antenna as claimed in claim 6, wherein when the electronic element is a circuit board or a cable, the second connecting portion is electrically connected by soldering and adhesive.

8. The manufacturing method of an antenna as claimed in claim 6, wherein when the electronic element is a second antenna, the second connecting portion comprises a second propping portion and the electronic element comprises a second hole, and the second propping portion passes through the second hole and props against the electronic element for fixation.

9. The manufacturing method of an antenna as claimed in claim 6, further comprising inserting the first connecting portion into an opening of the electronic element.

* * * * *